United States Patent [19]

Pinegar et al.

[11] Patent Number: 4,625,606

[45] Date of Patent: Dec. 2, 1986

[54] ROTARY CUTTING APPARATUS

[75] Inventors: Richard K. Pinegar; Ronald B. Bates, both of Caldwell, Id.

[73] Assignee: J. R. Simplot Company, Boise, Id.

[21] Appl. No.: 738,453

[22] Filed: May 28, 1985

[51] Int. Cl.[4] ..... B26D 3/24

[52] U.S. Cl. ..... 83/403; 83/404; 83/703

[58] Field of Search ..... 83/403–404.3, 83/703

[56] References Cited

U.S. PATENT DOCUMENTS

| | | | |
|---|---|---|---|
| D. 201,770 | 7/1965 | Urschel | D55/1 |
| 302,993 | 8/1884 | Frost . | |
| 2,086,708 | 7/1937 | Ferry | 83/404 |
| 2,126,361 | 8/1938 | Urschel et al. . | |
| 2,187,957 | 1/1940 | Urschel | 83/403 X |
| 2,195,879 | 4/1940 | Urschel et al. . | |
| 2,242,557 | 5/1941 | Urschel et al. . | |
| 2,436,410 | 2/1948 | Urschel et al. . | |
| 2,961,024 | 11/1960 | Urschel et al. . | |
| 3,053,296 | 9/1962 | Urschel et al. . | |
| 3,139,127 | 6/1964 | Urschel et al. . | |
| 3,139,128 | 6/1964 | Urschel et al. . | |
| 3,139,129 | 6/1964 | Urschel et al. . | |
| 3,139,130 | 6/1964 | Urschel et al. . | |
| 3,196,916 | 7/1965 | Urschel . | |
| 3,255,646 | 6/1966 | Urschel . | |
| 3,435,864 | 4/1969 | Urschel et al. . | |
| 3,472,297 | 10/1969 | Urschel et al. . | |
| 3,521,688 | 7/1970 | Urschel et al. . | |
| 3,823,880 | 7/1974 | Urschel et al. | 241/86 |
| 3,857,310 | 12/1974 | Tiby | 83/26 |
| 4,391,172 | 7/1983 | Galland et al. | 83/403 |

*Primary Examiner*—James M. Meister

*Attorney, Agent, or Firm*—Kelly, Bauersfeld & Lowry

[57] ABSTRACT

An improved rotary cutting apparatus is provided for cutting vegetables, particularly such as potatoes, into a distribution of strip sizes not exceeding a predetermined length limit. The apparatus comprises a conventional rotary impeller having peripheral blades for carrying potatoes into cutting relation with a slicing knife on an impeller housing for dividing the potatoes into slices followed by subsequent cutting into strips by strips knives on an adjacent cross-cut spindle. The impeller further includes an axially centered divider ring defining a pair of annular chambers for potato passage outwardly to the slicing knife, wherein longer potatoes are required to orient with their longitudinal axes extending generally radially with respect to the impeller, and generally perpendicular to the slicing knife, to limit the maximum length of the cut slices and the resultant cut strips. Arcuate paddles can be installed in association with the impeller blades to further improve potato alignment, and axial shims can be used to tailor the specific axial dimensions of the annular chambers.

23 Claims, 6 Drawing Figures

ROTARY CUTTING APPARATUS

BACKGROUND OF THE INVENTION

This invention relates generally to a rotary cutting apparatus for cutting vegetable products and the like into a plurality of segments for use in the food industry. More particularly, this invention relates to a rotary cutting apparatus designed to align a product, such as a potato, prior to cutting into strips not exceeding a maximum predetermined length.

Rotary cutting or slicing machines in general are known in the art and typically comprise a radially open impeller mounted for rotation within a stationary outer housing. See, for example U.S. Pat. Nos. 3,196,916 and 3,521,688. The vegetable product is typically fed axially into the interior of the impeller and is thrown or forced by centrifugal force in a radially outward direction into engagement with one or more cutting knives carried by the outer housing. A plurality of impeller blades secured to the periphery of the impeller carry the product rotationally about the interior of the housing for repeated cutting engagement with the cutting knife or knives so that the product is cut into a plurality of smaller slices or pieces.

Rotary cutting machines of this general type have been used to cut or slice a variety of vegetable products into smaller pieces having a variety of different sizes and shapes, depending upon the particular shape of the product fed into the machine and the particular configuration of the various cutting knives. For example, the machine has been adapted to cut whole potatoes into a plurality of slices which are delivered to an adjacent cross-cut spindle having a plurality of strip knives for dividing the slices into a plurality of French fry strips of uniform cross-sectional size and shape. In most instances, particularly in the cutting of whole potatoes into French fry strips, the rotary cutting machine has a size and shape and is geometrically oriented to maximize the average length of the final cut strips. For example, the rotary impeller has been oriented for rotation about a horizontal axis and the lengths and spacing of the peripheral impeller blades has been selected to permit longer potatoes fed axially into the impeller to fall between adjacent impeller blades in an orientation generally parallel with the horizontal axis of rotation. With this construction, these longer potatoes are also aligned generally in parallel with the slicing knife on the outer housing, resulting in potato slices of maximum length, thereby also resulting in maximum length French fry strips after cutting by the strip knives.

In certain circumstances, however, it has become desirable to limit the overall maximum length of individual cut strips. As an example, with the advent of the microwave oven and its increasing in-home use, it has become commercially advantageous to market parfried and frozen French fry potato strips in individual prepackaged serving units which can be quickly and easily heated for consumption in a microwave oven. The use of prepackaged serving units, however, inherently requires a product package of limited volumetric size containing only a few ounces of French fry strips, such as a paperboard carton having a length limit of about 4.5 inches as used by the J. R. Simplot Company, Boise, Id., with microwave reheatable French fries marketed under the trademark MICRO-MAGIC. With conventional rotary cutting machines designed to maximize French fry strip length, strips exceeding the limited package length of about 4.5 inches are commonplace, resulting in strips which will not fit into the package. In a modern high bulk volume packaging line, the presence of even a few French fry strips exceeding the package length will disrupt the packaging operation causing costly delays.

In the past additional cutting equipment has been proposed for use with rotary cutting machines as described above, wherein the additional cutting equipment has been designed to divide the potatoes or the cut strips in halves to avoid inclusion of strips having excessive length. However, the use of additional cutting equipment also unnecessarily divides shorter potato strips to increase substantially the overall distribution of short and sometimes unusable strips. Alternative strip length control techniques have utilized manual labor for selecting and hand cutting of potatoes having excessive length, but the use of manual labor is costly, requires individuals to handle knives thus creating the potential for injury, and further tends to slow production rate of a modern processing and packaging line. Still further, automated potato length grading equipment has been proposed for sorting out potatoes of excessive length, but such equipment is costly and occasionally permits passage of an undesirably long potato which, when cut, will disrupt the packaging process.

There exists, therefore, a significant need for an improved rotary cutting apparatus for limiting the length of cut French fry potato strips and the like automatically to a predetermined length limit without requiring additional cutting equipment, cutting steps, or the use of costly size grading equipment, and preferably by relatively simple and inexpensive modification of existing cutting machines. The present invention fulfills these needs and provides further related advantages.

SUMMARY OF THE INVENTION

In accordance with the invention, an improved rotary cutting apparatus comprises a rotary impeller installed in a stationary, generally cylindrical impeller housing having a slicing knife mounted thereon. One axial side of the impeller and housing are open for receiving a controlled flow of vegetable product, particularly such as potatoes, with the impeller including means for centrifugally carrying and orienting the potatoes into cutting relation with the slicing knife for dividing the potatoes into slices not exceeding a predetermined length limit. An adjacent cross-cut spindle having a plurality of strip knives divides the cut slices into a plurality of cut strips which thus also do not exceed the predetermined length limit.

In accordance with one preferred form of the invention, the rotary impeller is defined by a rotatably driven, generally circular backplate coupled to an axially spaced and generally annular face ring by a peripherally arranged plurality of axially extending impeller blades. An annular divider ring is disposed axially between the backplate and the face ring and cooperates therewith to define a pair of annular chambers each including radially open segments between adjacent impeller blades for radially outward potato passage into cutting relation with the slicing knife. The axial spacing of the divider ring relative to the backplate and the face ring is chosen to be equal to or less than the predetermined length limit for the final cut strips.

In operation, potatoes delivered into the impeller are each thrown centrifugally in a radial direction for outward package through one of the annular chambers into cutting relation with the slicing knife on the impeller housing. However, potatoes having a length exceeding the predetermined length limit are prevented by the divider ring from orienting generally axially relative to the impeller or, alternately stated, in longitudinal parallelism with the slicing knife. Instead, such longer potatoes are required to orient generally radially with respect to the impeller for passage through the open segments of the annular chambers, resulting in potato slices not exceeding the predetermined length limit. Appropriate control of potato flow rate into the impeller prevents such longer potatoes from becoming jammed prior to orientation and slicing.

In accordance with further aspects of the invention, for easy conversion of presently available rotary cutting equipment including an impeller with typically five or six peripherally mounted impeller blades, the divider ring is provided in a plurality of segments for facilitated installation between the impeller blades. In the preferred form, each divider ring segment is carried by an arcuate paddle including means for rapid mounting between the impeller bakcplate and face ring. The paddle is shaped to lie alongside the radially innermost edge of an associated impeller blade and to extend radially outwardly therefrom and angularly in a direction away from the direction of blade travel to assist in guiding potatoes into cradled relation with the trailing impeller blade. In addition, axial shims can be removably installed at the inboard faces of the backplate and/or the face ring to further tailor the sizes of the annular chambers.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
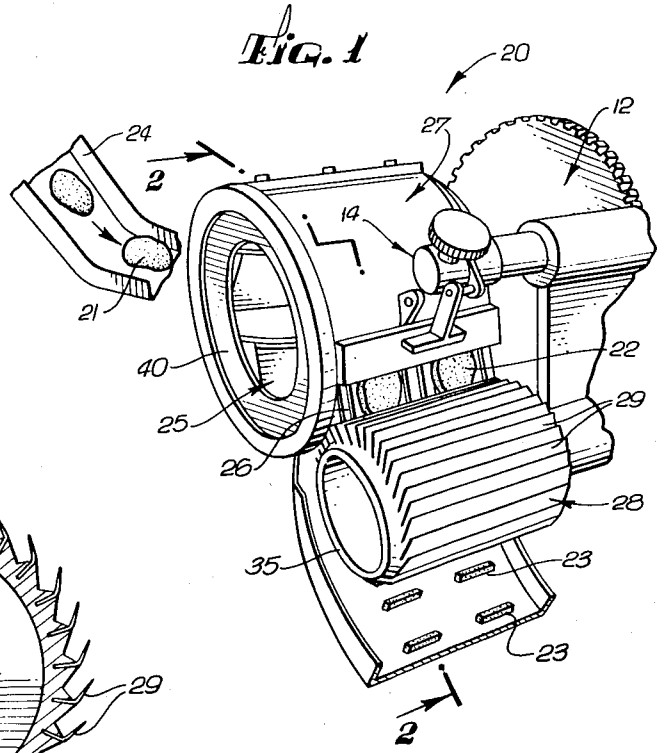
FIG. 1 is a perspective view of an improved rotary cutting apparatus embodying the novel features of the invention.

As illustrated in the exemplary drawings, the invention is embodied in an improved rotary cutting machine 20 for dividing vegetable products, such as potatoes or the like, into a plurality of small pieces. For example, the invention is particularly useful in cutting whole potatoes 21 into a plurality of slices 22 which are further cut into elongated French fry strips 23 of square cross section. The improved cutting assembly 20 is designed to orient the potatoes 21 prior to cutting to effectively limited the lengths of cut slices 22 and thus also the lengths of the cut strips 23 to a predetermined length limit. However, it is to be understood that the invention herein is applicable for use with a variety of other types and shapes of vegetables or nonvegetable products which are cut into small pieces of various shapes.

As in prior rotary cutting machines for similar purposes, the rotary cutting machine 20 as depicted in FIG. 1 includes a chute 24 in the form of a downwardly converging slide by which the potatoes 21 are supplied at a controlled flow rate for delivery into the machine. The chute 24 can be conveniently supported above the machine by a suitable support structure (not shown). The chute delivers the potatoes into an open-ended impeller 25 which is rotatably driven about a horizontal axis in a known manner to centrifugally throw the potatoes in a radially outward direction, as illustrated by the arrows 11 shown in FIG. 2, for cutting engagement with at least one slicing knife 26 supported by a stationary impeller housing 27, whereby the slicing knife 26 severs the potatoes into the slablike sections or slices 22. These slices 22 are immediately guided into a rotating strip knife assembly 28 having a plurality of strip knives 29 which cut the product into its final form, i.e., the French fry strips 23. This general type of rotary cutting machine is commercially available from Urschel Laboratories, Inc., Valparaiso, Ind., under the designation Urschel Model GRL Potato Cutter. See also the description of such cutters in U.S. Pat. No. 3,521,688, which is incorporated by reference herein.

In accordance with the present invention, the rotary cutting machine 20 is modified to include means for preventing formation of French fry strips 23 having a length beyond a predetermined maximum length limit. More particularly, the machine 20 is normally designed to accommodate relatively long potatoes, such as Russet Burbank variety, which frequently have a length of up to eight or nine inches. When such long potatoes are fed into the impeller 25, they normally assume an orientation generally parallel to the slicing knife 26 when thrown centrifugally into cutting relation therewith, thereby resulting in slices 22 of maximum length followed by cutting of strips 23 of a normally desirable maximum length. However, in some instances, packaging or other limitations may make it desirable to restrict the maximum strip length to a shorter limit, such as about four or four and one-half inches. The present invention provides relatively simple means for orienting the potatoes within the impeller 25 prior to cutting to prevent strip formation beyond a predetermined length limit.

In keeping with the invention and as illustrated in the accompanying drawing figures, the impeller 25 comprises a generally annular face ring 40 joined to a circular backplate 41 by a circumferentially arranged set of impeller blades 30. As illustrated best in FIGS. 3 and 4, these impeller blades 30 are fastened to the face ring 40 and the backplate 41 by any conventional method, such as by welding or the like, and are oriented to extend axially between the peripheries thereof. Each impeller blade 30 lies generally in a radial plane and typically is somewhat curved or arched along its length to provide a degree of concavity presented in the direction of impeller rotation to cradle and carry potatoes 21 into cutting relation with the slicing knife 26, as will be described. The annular shape of the face ring 40 defines a central axial opening 42 through which the potatoes are fed via the chute 24, while the backplate 41 is solid and prevents the product from flowing axially out of the impeller 25. A drive motor unit referred to generally by reference numeral 12 (FIG. 1) includes an appropriate drive shaft (not shown) connected to the backplate 41 for rotatably driving the impeller 25 about a horizontal axis.

The impeller 25 is carried within the housing 27 which also has a generally annular shape and is axially open at one end to permit potato infeed through the central opening 42 in the face ring 40. This housing 27 is sized and shaped for relatively close clearance with respect to the radially outermost extents of the face ring 40, backplate 41, and impeller blades 30. At one point about the periphery of the housing 27, an axially extending gap 13 is lined on one side by the slicing knife 26 which is supported by a slicing knife assembly 14 to span the axial dimension of the housing 27. A manually adjustable control knob 15 of the slicing knife assembly 14 is adjustable to vary the knife position relative to the gap 13 and thereby also vary the thickness of the slices 22 to be cut, as will be described.

In accordance with a primary aspect of the invention, the impeller 25 is subdivided into a pair of radially open annular chambers each defined further by a plurality of radially open arcuate segments. The size and shape of these arcuate segments are closely controlled to regulate the orientation of longer potatoes 21 fed into the machine in a manner limiting the maximum length of potato slices 22 to be cut.

Figure 2:
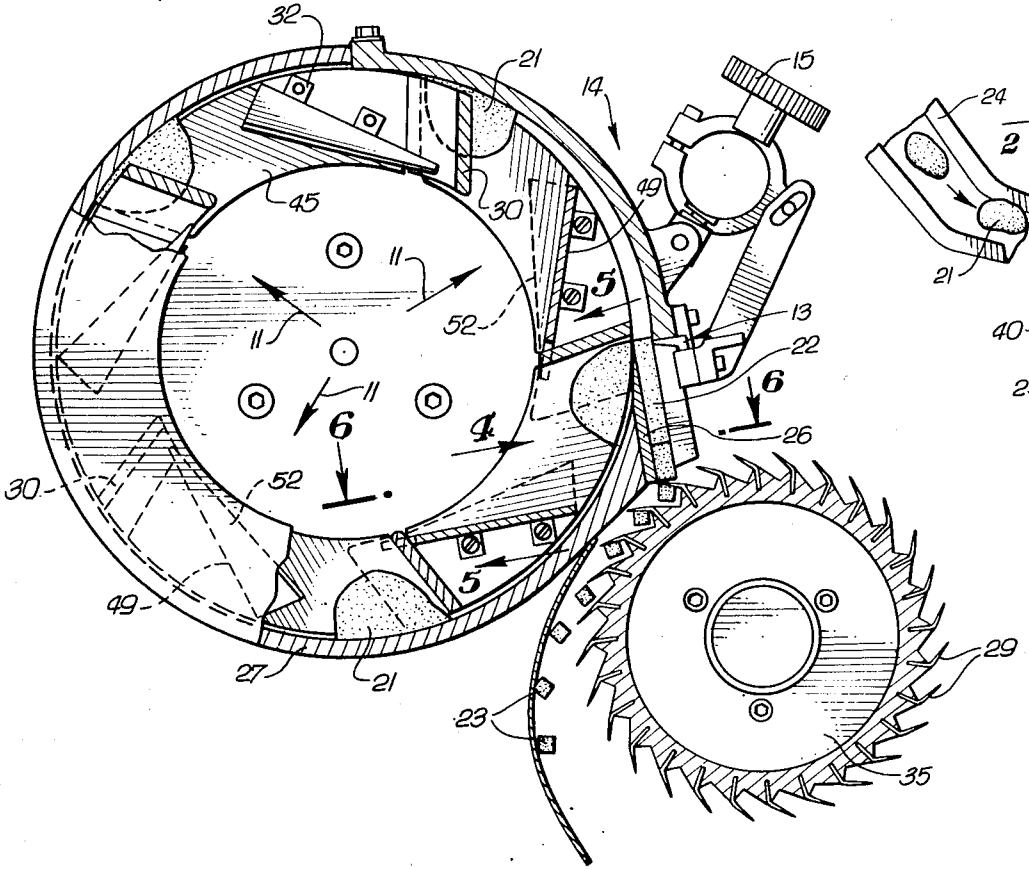
FIG. 2 is a vertical sectional view taken substantially along line 2—2 of FIG. 1 and illustrating cutting of potatoes or the like into French fry strips.
Figure 3:
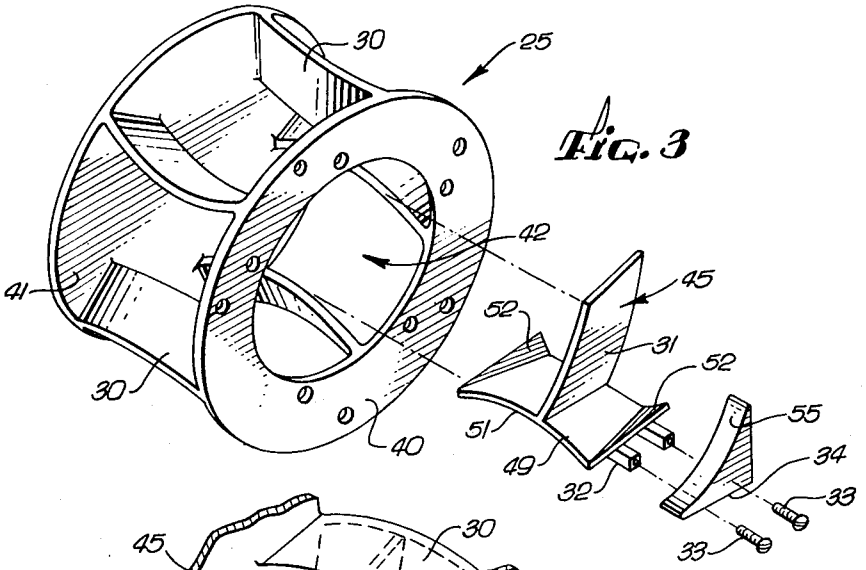
FIG. 3 is an exploded perspective view illustrating the various parts of an impeller assembly of the rotary cutting apparatus.
Figure 4:
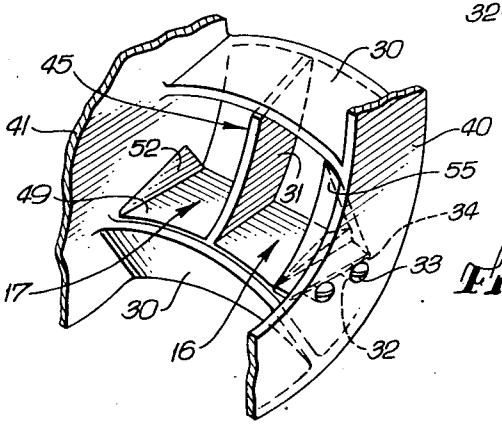
FIG. 4 is an enlarged fragmented perspective view of a portion of the impeller assembly.

More particularly, as shown best in FIGS. 2–4, the impeller 25 includes a central divider ring 45 positioned, in a preferred form of the invention, generally axially centered between the face ring 40 and the backplate 41. This divider ring 45 thus cooperates with the face ring 40 to define one annular chamber 16 and further cooperates with the backplate 41 to define a second annular chamber 17, wherein these chambers 16 and 17 have axial dimensions substantially less than the total axial span of the impeller. These annular chambers 16 and 17 are each subdivided in turn by the plurality of impeller blades 30 into a plurality of arcuate segments through which the potatoes 21 are thrown centrifugally toward the housing 27 and the slicing knife 26.

In the preferred construction of the invention, the divider ring 45 is designed for relatively simple installation into an existing rotary cutting machine by providing the divider ring in a plurality of part-circle sections 31 each anchored at one end to an axially extending paddle 49, as shown in FIGS. 3 and 4. This paddle 49 is sized to fit between the face ring 40 and the backplate 41, with mounting struts 32 being provided on the underside of the paddle for convenient reception of mounting screws 33 passed through the face ring 40 and the backplate 41. The radially innermost edge 51 of each paddle 49 fits closely along the arched contour of one of the impeller blades 30 and the paddle extends therefrom radially outwardly and angularly in a direction away from the direction of impeller rotation terminating generally at the impeller periphery. Angled side wings 52 at the opposite sides of the paddle 49 may be provided for smooth contour and merger with the face ring 40 and the backplate 41, respectively. Shims 55 may also be provided with modified paddles having a length shorter than the axial spacing between the face ring 40 and the backplate 41 to control the axial dimension of one or both annular chambers 16 and 17, with each shim 55 having a base 34 anchored by welding or the like onto the mounting struts 32 of the associated paddle.

Figure 5:
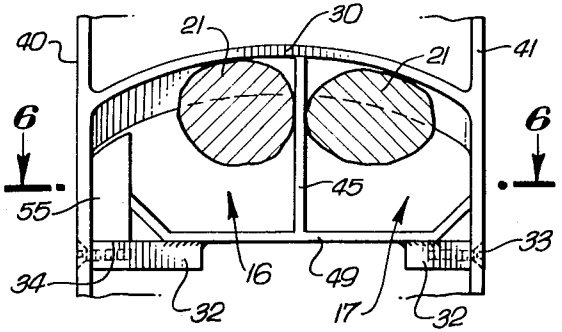
FIG. 5 is a partial cross-sectional view taken substantially along line 5—5 of FIG. 2 and illustrating potatoes or the like carried by the impeller assembly.
Figure 6:
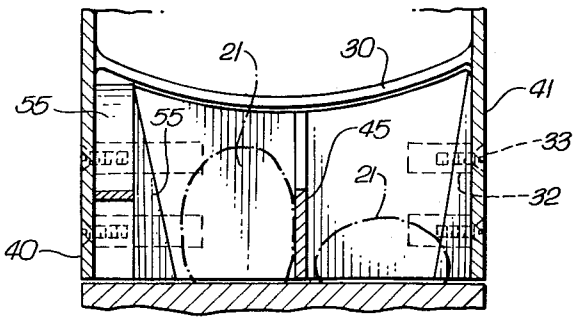
FIG. 6 is a partial cross-sectional view taken substantially along line 6—6 of FIG. 2 and further illustrating potatoes or the like carried by the impeller assembly.

In operation, potatoes 21 delivered via the chute 24 into the machine are guided by the rotating impeller 25 through one of the annular chambers 16 and 17 into cutting relation with the slicing knife 26. More specifically, potatoes having a length dimension less than the axial dimension of the chambers 16 and 17 will pass in virtually any orientation into one of the chamber segments, with the angularly set paddles 49 tending to guide the potatoes toward a cradled relation with a respective trailing arched impeller blade 30 which in turn sweeps the potato into cutting relation with the slicing knife 26. However, potatoes having a length longer than the axial dimension of the chambers 16 and 17 are required to orient with their long dimensions extending generally radially relative to the impeller for entry into one of the chamber segments, as shown in FIGS. 5 and 6. When oriented in this manner, the longer potatoes are guided by the paddles 49 toward cradled relation with the adjacent arched impeller blades 30 and are carried thereby into slicing relation with the knife 26. This slicing step thus occurs with the longer potatoes still in a generally radial orientation to provide slices 22 having a length generally not exceeding the axial dimension of the associated annular chamber 16 or 17. The longer potatoes are thus prevented from orienting with their long dimensions generally parallel with the slicing knife 26 which would otherwise result in slices of excessive or maximum length.

The cut slices 22 are delivered directly and in a known manner to the strip knife assembly 28 as shown in FIGS. 1 and 2. This strip knife assembly 28 includes a rotary knife wheel 35 which carries an axially extending set of parallel strip knives 29 oriented also in parallel with the slicing knife 26. These strip knives 29 thus cut the potato slices 22 into individual strips 23 typically of square cross section for use as French fries. Importantly, since the lengths of the potato slices 22 are limited due to the orienting of longer potatoes prior to slicing, the lengths of the resultant cut strips 23 are similarly limited.

The improved cutting apparatus of the invention is especially useful in the high volume production of French fried potatoes in a partially cooked and frozen state and packaged in small or individual serving sized packages designed for rapid reconstitution for consumption. One example of such product is the parfried and frozen French fry strips processed and sold by the J. R. Simplot Company, Boise, Id., under the name MICRO-MAGIC, wherein the strips are packaged in single-serving sized paperboard cartons permitting rapid reconstitution in a microwave oven without prior removal from the carton. Such cartons have a limited height of about 4.5 inches, whereby it is advantageous to set the above-described rotary cutting machine to produce cut potato strips 23 having a maximum length of about 4 inches. The resultant strips will thus fit quickly and easily into the cartons without jamming or otherwise interrupting quantity production processes.

A variety of modifications and improvements to the rotary cutting apparatus described herein are believed to be apparent to those skilled in the art. Accordingly, no limitation on the invention is intended by way of the foregoing description and drawings, except as specifically set forth in the appended claims.

What is claimed is:

1. A rotary cutting apparatus for cutting a product such as vegetables or the like, comprising:

a generally cylindrical housing having an axially extending slot formed therein;

a slicing knife mounted on said housing in a position lining one side of said slot;

a generally cylindrical impeller mounted for rotational movement within said housing, said impeller including a generally annular face ring separated axially from a generally circular backplate by a plurality of axially extending impeller blades extending therebetween in circumferentially spaced relation about the peripheries thereof; and a generally annular divider ring mounted on said impeller blades in a position axially between said face ring and said backplate, said divider ring cooperating with said face ring and said backplate for respectively defining first and second annular chambers for radially outward passage of the product upon rotation of said impeller into cutting relation with said slicing knife, each of said chambers being subdivided by said impeller blades into arcuate segments.

2. The rotary cutting apparatus as defined in claim 1 wherein said slicing knife is adjustably mounted on said housing.

3. The rotary cutting apparatus as defined in claim 1 wherein said divider ring is defined by a plurality of divider ring segments each mounted between an adjacent pair of said impeller blades.

4. The rotary cutting apparatus as defined in claim 1 wherein said impeller face ring defines an opening through which the product may pass into said impeller, said backplate providing a barrier to contain the product within said impeller.

5. The rotary cutting apparatus as defined in claim 1 wherein said divider ring is spaced in parallel relationship from and located generally midway axially between said impeller face ring and said backplate.

6. The rotary cutting apparatus as defined in claim 5 including means for variably adjusting the axial dimensions of said first and second annular chambers.

7. The rotary cutting apparatus as defined in claim 1 wherein said divider ring comprises a plurality of arcuate divider ring segments each supported at one end by an axially extending paddle, each of said divider ring segments and its associated paddle being positionable between an adjacent pair of said impeller blades with said paddle extending axially between said face ring and said backplate and with the radially innermost edge of said paddle lying generally alongside one of said blades and said paddle extending radially outwardly therefrom with an angular component of direction extending away from the direction of impeller rotation, said divider ring segments extending from said paddle toward and terminating generally in abutting relation with the other of said adjacent pair of impeller blades.

8. The rotary cutting apparatus as defined in claim 7 including means for mounting each of said divider ring segments and their associated paddles between a respective adjacent pair of said impeller blades.

9. The rotary cutting apparatus as defined in claim 7 including shim means for mounting on related ones of said paddles for variably adjusting the axial dimensions of said first and second annular chambers.

10. The rotary cutting apparatus as defined in claim 7 wherein each of said paddles includes wings at the opposite axial ends thereof projecting angularly in a direction away from the direction of impeller rotation.

11. The rotary cutting apparatus as defined in claim 1 wherein the product is a potato.

12. A rotary cutting apparatus for cutting a product such as vegetables and the like, comprising;

a generally cylindrical housing having an axially extending slot formed therein;

a slicing knife mounted on said housing in a position lining one side of said slot;

an impeller mounted for rotational movement inside said housing, said impeller having a generally annular face ring at one axial end which defines an opening through which product may flow, and a backplate at an opposite axial end which provides a barrier to prevent the flow of product therefrom;

a plurality of circumferentially spaced impeller blades extending generally axially between the peripheries of said face ring and said backplate, and means mounted axially between said face ring and said backplate for orienting selected ones of the product having a length exceeding a predetermined limit in an orientation extending generally radially with respect to said impeller for centrifugal passage upon rotation of said impeller in a radially outward direction for cutting relation with said slicing knife, thereby limiting the lengths of product slices cut by said knife to a predetermined length limit.

13. The rotary cutting apparatus as defined in claim 12 further including strip knife means adjacent said housing for cutting said product slices into strips.

14. The rotary cutting apparatus as defined in claim 12 wherein said orienting means comprises a generally annular divider ring mounted on said impeller blades in a position axially between said face ring and said backplate.

15. The rotary cutting apparatus as defined in claim 14 wherein said divider ring is defined by a plurality of divider ring segments each mounted between an adjacent pair of said impeller blades.

16. The rotary cutting apparatus as defined in claim 14 wherein said divider ring comprises a plurality of arcuate divider ring segments each supported at one end by an axially extending paddle, each of said divider ring segments and its associated paddle being positionable between an adjacent pair of said impeller blades with said paddle extending axially between said face ring and said backplate and with the radially innermost edge of said paddle lying generally alongside one of said blades and said paddle extending radially outwardly therefrom with an angular component of direction extending away from the direction of impeller rotation, said divider ring segments extending from said paddle toward and terminating generally in abutting relation with the other of said adjacent pair of impeller blades.

17. A rotary cutting apparatus for cutting a product such as vegetables or the like into slices, comprising:

a generally cylindrical housing having an axially extending slot formed therein;

a slicing knife mounted on said housing and lining one side of said slot;

means for carrying the product within said housing centrifugally in radially outward direction into cutting relation with said slicing knife to divide the product into slices, said carrying means comprising an impeller having an opening at one axial end through which the product may flow; and means mounted axially between the opposite axial ends of said impeller to divide said impeller into at least two annular chambers each having an axial dimension for orienting selected ones of the product having a length exceeding a predetermined limit in an orientation extending generally radially relative to said housing for travel centrifugally into cutting relation with said slicing knife thereby limiting the lengths of cut slices to a predetermined length limit.

18. The rotary cutting apparatus as defined in claim 17 further including strip knife means adjacent said housing for cutting said product slices into strips.

19. The rotary cutting apparatus as defined in claim 17 wherein the product is a potato.

20. A rotary cutting apparatus for cutting a product such as potatoes or the like into slices, comprising:

a generally cylindrical housing having an axially extending slot formed therein;

a slicing knife mounted on said housing in a position lining one side of said slot;

a generally cylindrical impeller mounted for rotational movement inside said housing, said impeller being defined by a generally annular face ring at one axial end and a generally circular backplate at its other axial end, and a plurality of circumferentially spaced and generally radially extending impeller blades connected between the peripheries of said face ring and said backplate; and a plurality of divider ring section units for mounting onto said impeller blades between said face ring and said backplate, each of said units including an arcuate divide ring segment for extending generally circumferentially between an adjacent pair of said impeller blades and a paddle for extending generally circumferentially between an adjacent pair of said impeller blades and a paddle for extending generally axially between said face ring and said backplate and with the radially innermost edges of said paddle lying alongside the radially innermost edge of one of said adjacent pair of blades and said paddle extending radially outwardly therefrom with an angular directional component extending away from the direction of impeller rotation, and means for mounting said paddle between said face ring and said backplate;

said divider ring segments of said units cooperating to define an annular divider ring between said face ring and said backplate for respectively defining first and second annular chambers for radial passage of the product into cutting relation with said slicing knife.

21. The rotary cutting apparatus as defined in claim 20 further including strip knife means adjacent said housing for cutting said product slices into strips.

22. The rotary cutting apparatus as defined in claim 20 including shim means for mounting on selected ones of said paddles for variably adjusting the axial dimensions of said first and second annular chambers.

23. The rotary cutting apparatus as defined in claim 20 wherein each of said paddles includes wings at the opposite axial ends thereof projecting angularly in a direction away from the direction of impeller rotation.

* * * * *